US005919750A

United States Patent [19]

Iacobucci

[11] Patent Number: 5,919,750

[45] Date of Patent: Jul. 6, 1999

[54] FABRIC SOFTENER COMPOSITION

[75] Inventor: Paul Iacobucci, Patterson, N.Y.

[73] Assignee: Akzo Nobel NV, Arnhem, Netherlands

[21] Appl. No.: 08/899,940

[22] Filed: Jul. 24, 1997

[51] Int. Cl.[6] ..... D06M 13/46

[52] U.S. Cl. ..... 510/515; 510/521; 510/522; 510/527

[58] Field of Search ..... 510/515, 521, 510/522, 527

[56] References Cited

U.S. PATENT DOCUMENTS

| | | | |
|---|---|---|---|
| 4,308,151 | 12/1981 | Cambre | 510/305 |
| 4,429,859 | 2/1984 | Steiner et al. | 510/524 |
| 4,456,554 | 6/1984 | Walz et al. | 554/84 |
| 4,555,447 | 11/1985 | Sieloff et al. | 428/392 |
| 4,661,269 | 4/1987 | Trinh et al. | 510/522 |
| 4,789,491 | 12/1988 | Chang et al. | 510/525 |
| 4,832,856 | 5/1989 | Rutzen et al. | 510/526 |
| 4,923,642 | 5/1990 | Rutzen et al. | 554/46 |
| 5,023,003 | 6/1991 | Yamamura et al. | 510/515 |
| 5,296,622 | 3/1994 | Uphues et al. | 554/103 |

FOREIGN PATENT DOCUMENTS

| | | | |
|---|---|---|---|
| 1163275 | 3/1984 | Canada . | |
| 0021431 | 1/1981 | European Pat. Off. . | |
| 0267551 | 5/1988 | European Pat. Off. . | |
| 0281975 | 9/1988 | European Pat. Off. . | |
| 1593921 | 7/1970 | France . | |
| 4242480 | 6/1994 | Germany . | |
| 4243701 | 6/1994 | Germany . | |
| 1004546 | 10/1966 | United Kingdom | C07C 127/00 |
| 9203526 | 3/1992 | WIPO . | |
| 9303132 | 2/1993 | WIPO . | |
| 9321291 | 10/1993 | WIPO . | |
| WO 94/20597 | 9/1994 | WIPO | C11D 3/00 |
| WO 98/03618 | 1/1998 | WIPO | C11D 1/62 |

OTHER PUBLICATIONS

*International Search Report*, dated Dec. 10, 1998.

*Primary Examiner*—Anthony Green
*Attorney, Agent, or Firm*—Dilworth & Barrese

[57] ABSTRACT

A fabric softener composition with improved fabric softening performance is based upon a mixture of quaternary ammonium fatty acid derivatives one of which is obtained from partially hydrogenated soy triglyceride or fatty acids derived from such triglyceride possessing certain properties of cis/trans isomer ratio and iodine value and the other of which is obtained from tallow acids.

20 Claims, No Drawings

FABRIC SOFTENER COMPOSITION

BACKGROUND OF THE INVENTION

This invention relates to fabric softener compositions containing quaternized derivatives of fatty acids. More particularly, the invention relates to a fabric softener composition containing at least two different quaternary ammonium fatty acid derivatives, one such derivative being based on fatty acids obtained from soy and the other being based on fatty acids derived from tallow.

Fabric softeners are compositions containing one or more active substances which are used in the laundering process to provide laundered fabrics with a texture or hand that is smooth, pliable and soft to the touch. Fabric softeners generally contain one or more cationic surfactants in the form of water-insoluble quaternary ammonium compounds in which the ammonium nitrogen atom contains at least two long chain acyclic aliphatic hydrocarbon groups.

SUMMARY OF THE INVENTION

In accordance with the present invention, a fabric softener composition is provided which comprises:

a) a first quaternary ammonium fatty acid derivative obtained by the process which comprises reacting partially hydrogenated soy triglyceride or partially hydrogenated fatty acids obtained from soy triglyceride, the aliphatic residues of which possess a ratio of cis isomer to trans isomer of from about 1:1 to about 15:1 and an iodine value of not less than about 30 and not greater than about 70, with a secondary amine of the formula X'—R'—NH—R"—X" in which X' and X" each is the same or different and is —OH or —$NH_2$ and R' and R" each is the same or different and is alkylene of from 2 to about 6 carbon atoms in a mole ratio of triglyceride/fatty acid to amine of at least about 1.85:1 to provide the corresponding aminodiester, -diamide or -esteramide, alkoxylating the aminodiester, -diamide or -esteramide with an alkylene oxide selected from the group consisting of ethylene oxide, propylene oxide and butylene oxide in a mole ratio of alkylene oxide to aminodiester, -diamide or -esteramide of up to about 8:1 to provide an alkoxylated fatty acid derivative and quaternizing the alkoxylated fatty acid derivative with alkylating agent to provide the corresponding quaternary ammonium fatty acid derivative; and, b) a second quaternary ammonium fatty acid derivative obtained from tallow acids.

Surprisingly, it has been found that the foregoing fabric softener composition provides significantly better softening performance than a fabric softener composition containing an equivalent amount of quaternary ammonium fatty acid derivative obtained entirely from tallow acids.

DESCRIPTION OF THE PREFERRED EMBODIMENTS

The first of the quaternary ammonium fatty acid derivatives present in the fabric softener composition of this invention is obtained by derivatizing one or more fatty acids obtained from soy triglycerides. The soy triglyceride or free fatty acid(s) derived from soy triglyceride are first hydrogenated employing known and conventional procedures to provide a partially hydrogenated product in which the aliphatic residues possess a ratio of cis isomer to trans isomer of from about 1:1 to about 15:1, preferably from about 2:1 to about 9:1, and an iodine value of not less than about 30 and not greater than about 70 and preferably not less than about 35 and not greater than about 58. It is generally preferred to hydrogenate soy triglyceride; however, the free fatty acids can also be hydrogenated. Care is taken to reduce or remove polyunsaturates that may be present in the hydrogenated product in order to increase the color and odor stability of the quaternary ammonium derivatives ultimately obtained therefrom. Generally useful hydrogenation conditions for hydrogenating soy triglycerides include the use of from about 0.02 to about 0.15 weight percent of a typical hydrogenation catalyst such as Nickel supported catalyst e.g., G49B® from United Catalysts, Inc., Louisville, Ky., a filter aid such as Celite® or diatomaceous earth in the usual amount of from about 0.05 to about 5% of the material being filtered, hydrogen gas at a pressure of from 50 psi to about 600 psi, a temperature of from about 60° to about 150° C. and a reaction time of from about 0.5 to about 4 hours.

One example of the C-chain distribution of a soy triglyceride both before and following partial hydrogenation in accordance with this invention can be as follows:

| | $C_{16}$:0 | $C_{18}$:0 | $C_{18}$:1 | $C_{18}$:2 | $C_{18}$:3 |
|---|---|---|---|---|---|
| Before Hydrogenation, % | 11 | 4.0 | 21 | 55.5 | 18.5 |
| Following Hydrogenation, % | 11 | ~30 | ~60 | ~0 | ~0 |

Other distributions can be achieved depending on the conditions of hydrogenation.

Hydrogenation conditions other than those stated can be used as appreciated by those skilled in the art provided, of course, that the foregoing properties of cis to trans isomer ratio and iodine value are obtained in the partially hydrogenated product.

The partially hydrogenated soy glyceride/fatty acids are then reacted with a secondary amine of the general formula

X'—R'—NH—R"—X"

in which X' and X" each is the same or different and is —OH or —$NH_2$, and R' and R" each is alkylene of from 2 to about 6 carbon atoms. The secondary amine can thus possess two hydroxyl groups, two primary amine groups or a hydroxyl group and a primary amine group. A preferred secondary amine reactant is diethylenetriamine. The glyceride/fatty acids are reacted with the secondary amine in a mole ratio of at least about 2:1 based on the number of moles of free or bound fatty acids. This reaction provides a diester, diamide or ester amide (depending on the nature of the X' and X" groups) which can be represented by the following general formula (I):

R—CO—X'—R'—NH—R"—X"—CO—R (I)

in which each R is the same or different and is the residue of partially hydrogenated soy triglyceride/fatty acids possessing the aforementioned ranges of cis/trans isomer ratio and maximum iodine value.

This reaction product is preferably stabilized with an antioxidant/reducing agent (such as, e.g., BHT/sodium borohydride) to preserve its color and odor qualities. Preferably the antioxidant is a phenolic antioxidant including but not limited to 3,5-Di-tert-butyl-4-hydroxy toluene (BHT); 3,5-Di-tert-butyl-4-hydroxy anisole (BHA); Corn oil-60%, butylated hydroxytoluene-20%, butylated hydroxyanisole-10%, propyl gallate-6%, citric acid-6% (Tenox®6); octadecyl 3-(3,5-di-tert-butyl-4-hydroxyphenyl)propionate (Irganox®10); and 3,5-Di-tert-butyl-4-hydroxyhydrocinnamic acid, triester with 1,3,5-tris(2-hydroxyethyl)-s-triazine-2,4,6(1H,3H,5H)-trione (Irganox®

3125). IRGANOX® 1076 and IRGANOX® 3125 are trademarks of Ciba Geigy Corporation, while TENOX®4 and TENOX®6 are trademarks of Eastman Chemical Co. Other antioxidants useful herein are readily apparent to one of ordinary skill in the art and can be found, for example, in McCutchen's Functional Materials, 1995 (McPublishing Co., N.J., U.S.A.) the relevant portions thereof being incorporated herein by reference.

The reaction product of the foregoing general formula (I) is also preferably alkoxylated with an alkylene oxide such as ethylene oxide, propylene oxide or butylene oxide to provide the corresponding alkoxylated diester, diamide or esteramide. The mole ratio of alkylene oxide to diester, diamide or esteramide is at least 1 to about 8 and is preferably from about 1 to about 4. The alkoxylated product can be represented by the following general formula (II):

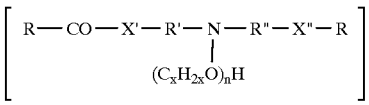

(II)

in which x is 2 to 4 and n is 1 to about 8 and preferably 1 to 4.

The alkoxylated product is then quaternized with any of several known and conventional alkylating agents, e.g., those of the formula $$R'''_m A$$

in which R''' is hydrogen, an alkyl radical of 1 to about 4 carbon atoms or a phenalkyl radical of 1 or 2 carbon atoms in the alkyl radical, m is the valence A and A is the residue of an organic or inorganic acid. Examples of suitable alkylating agents include the alkyhalides such as methyl chloride, the benzylhalides such as benzyl chloride and the dialkylsulfates such as dimethyl sulfate. The resulting quaternized fatty acid derivative can be presented by the formula

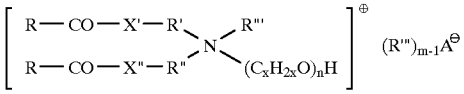

The second quaternary ammonium fatty acid derivative can be represented by the general formula

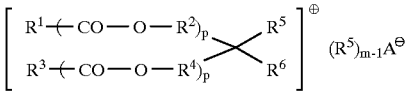

in which $R^1$ and $R^3$ each is the same or different and is the hydrogenated residue of fatty acid derived from tallow and is selected from $C_{12}$–$C_{22}$ straight or branched chain alkyl or alkylene groups, P is 0 or 1, $R^2$ and $R^4$ each is alkylene of from 2 to 6 carbon atoms, $R^5$ is alkyl of 1 to 4 carbon atoms, $R^6$ is alkyl of 1 to 4 carbon atoms or $(C_xH_{2x}.O)_n$ wherein x is 2 to 4 and n is 1 to 8, m is the valence of A and A is as defined above.

The preferred second quaternary ammonium fatty acid derivatives are those in which $R^2$ and $R^4$ each is —$CH_2CH_2$— and $R^5$ and $R^6$ each is methyl.

The fabric softener composition can contain (a) and (b) in a weight ratio of (a) to (b) of about 8:1 to 1:6 and preferably about 6:1 to 1:4 together with one or more known and conventional additives such as fragrance, colorant, stabilizing agent, additional surfactant(s), antioxidants, chelating agents, and the like, in the usual amounts.

Components (a) and (b) and optional additives are dispersed in water to provide a finished fabric softener product. The amount of water can represent from about 40 to about 98 weight percent of the total composition and preferably from about 50 to about 96 weight percent of the total composition of the dispersed product based on the amount of combined components (a) and (b). Such dispersions will possess a quaternary activity of at least about 2 percent and preferably at least about 4 percent.

The following examples are further illustrative of the fabric softener composition herein.

EXAMPLE 1

In this Example, three fabric softener dispersions are prepared for evaluation in a sensory evaluation for softening effectiveness and in quantitative evaluations for rewetting of treated fabric. A 1.5 liter resin kettle equipped with an electric motor to drive the agitator is used to prepare the dispersions. Pre-blends of quaternary ammonium compounds are made prior to their addition to the water.

In the first pre-blend, 50.2 grams of dihydrogenated tallow dimethyl ammonium chloride is heated to 60° C. and combined with 92.6 grams of hydroxypropyl di(partially hydrogenated soya) methyl amidoamine methylsulfates (starting triglyceride I.V.=20). The two products are mixed to form a homogeneous blend to be used as the quaternary pre-blend for preparing the softener dispersion.

To prepare a softener dispersion using the pre-blend, 350 grams of deionized water (DI) is heated to 65° C. and added to the resin kettle which is jacketed to maintain the formulating temperature between 60° and 70° C. With agitation, 3.75 grams of a dispersant (Igepal® CO-720 from Rhone-Poulenc) is added to the water and solubilized. Next, 142.8 grams of the molten quaternary pre-blend is added to the stirring hot water with intermediate additions of calcium chloride to maintain a handlable viscosity at all times. After the incorporation of quaternary pre-blend is completed the temperature of the batch is allowed to fall to 40° C. At that time 3.75 grams of fragrance (Bush, Boake, and Allan 920165) is incorporated. The pH of the dispersion is adjusted to 4.5–5.0 with 1N HCl and then the dispersion was colored and final viscosity adjusted with calcium chloride. The net weight of the dispersion is then adjusted to 500 grams. The formulation is allowed to age for approximately 1 week prior to evaluation for softening effectiveness.

A second dispersion in accordance with this disclosure is prepared in a similar manner except that the amidoamine quaternary used is based upon a partially hydrogenated soya triglyceride where the triglyceride had been hydrogenated to an I.V. of 50 cg/gm.

The aforementioned products were then compared with a softener dispersion formulated as above with the exception being that a hydroxypropyl ditallow methyl amidoamine methyl sulfate is used in place of the similar product based upon soya triglyceride.

Garments were then treated using the three dispersions by washing seven pounds of fabric in a topload clothes washer and adding about one fluid ounce of the dispersion (24% actives) during the rinse cycle. The use level per treatment was approximately 7 grams of active per 7 lbs. of fabric. The garments were dried for 50 minutes on a high setting in a tumble drier and then bagged and allowed to equilibrate for 24 hrs. Next, pairs of towels were presented to trained panelists with the requirement that they judge which towel of the pair to be softer. No judgment of equality was permitted. The number of judges ranged from 18 to 24 for each test conducted.

The results indicated that the dispersion made from soya triglyceride (I.V.=50) gave the best softening performance. When the I.V. of the soya triglyceride was 20, the performance relative to the tallow-based product decreased. This was surprising and an unexpected result based upon knowledge of those skilled in the art regarding I.V. and its influence on softening performance.

In several tests the softening preference was compared for the I.V.=20 soya triglyceride amidoamine quaternary to that of the tallow-based quaternary and the softening preference for the I.V.=50 soya triglyceride amitoamine quaternary was compared to that of the tallow-based quaterary. The results can be summarized as follows:

| | AAQ (Tallow based) | AAQ (I.V. = 20 soya triglyceride) |
|---|---|---|
| Test 1 | 67% | 33% |
| Test 2 | 72% | 28% |
| Test 3 | 71% | 29% |
| | AAQ (Tallow based) | AAQ (I.V. = 50 soya triglyceride) |
| Test 4 | 29% | 71% |
| Test 5 | 40% | 60% |
| Test 6 | 35% | 65% |

EXAMPLE 2

In a second example three softener dispersions were prepared in the same manner as in Example 1. The alkyl chain source of the amidoamine quaternary used to form the first dispersion was a soya triglyceride of I.V.=60. A second dispersion was also prepared but with the amidoamine quaternary sourced from a partially hydrogenated soya triglyceride with an I.V. of 70. Again a reference or comparative dispersion was prepared using an amidoamine quaternary based on tallow triglyceride (I.V.=55).

The three dispersions were allowed to age for one week prior to softening evaluation. Whereas in the previous example the odor and color of the dispersion remained substantially the same over time, in the product formulated with amidoamine quaternary sourced from partially hardened soya triglyceride I.V.=70, the dispersion darkened slightly and had taken on a rancid odor. The color and odor characteristics of the other two softener dispersions remained substantially the same as when the product was first formulated. Because the I.V.=70 sample began to show signs of color and odor degradation, this dispersion was not evaluated for softening performance.

Fabric was treated and evaluated as in example 1. The results of evaluation are summarized below:

| | AAQ (Tallow Based) | AAQ (PH Soya triglyceride I.V. = 60) |
|---|---|---|
| Test 1 | 17% | 83% |

It will be understood that various modifications may be made to the embodiments disclosed herein. Therefore, the above description should not be construed as limiting, but merely as exemplifications of preferred embodiments. Those skilled in art will envision other modifications within the scope and spirit of the claims appended hereto.

What is claimed is:

1. A fabric softener composition comprising:

a) a first quaternary ammonium fatty acid derivative obtained by the process which comprises reacting partially hydrogenated soy triglyceride or partially hydrogenated fatty acids obtained from soy triglyceride, wherein aliphatic residues of the partially hydrogenated soy triglyceride or partially hydrogenated fatty acids thereof possess a ratio of cis isomer to trans isomer of from about 1:1 to about 15:1 and an iodine value of not less than about 30 and not greater than about 70, with a secondary amine of the formula X'—R'—NH—R"—X" in which X' and X" each is the same or different and is —OH or —$NH_2$ and R' and R" each is the same or different and is alkylene of from 2 to about 6 carbon atoms in a mole ratio of fatty acid to amine of at least about 1.85:1 to provide an aminodiester, -diamide or -esteramide, alkoxylating the aminodiester, -diamide or -esteramide with an alkylene oxide selected from the group consisting of ethylene oxide, propylene oxide and butylene oxide in a mole ratio of alkylene oxide to aminodiester, -diamide or - esteramide of up to about 8:1 to provide an alkoxylated fatty acid derivative and quaternizing the alkoxylated fatty acid derivative with alkylating agent to provide the quaternary ammonium fatty acid derivative; and b) a second quaternary ammonium fatty acid derivative obtained from tallow acids, wherein the weight ratio of (a) to (b) in the composition is from about 8:1 to about 1:6.

2. The fabric softener composition of claim 1 wherein the weight ratio of (a) to (b) is from about 6:1 to about 1:4.

3. The fabric softener composition of claim 1 containing (a) and (b) dispersed in an amount of water which is at least 40 weight percent by weight of the total composition.

4. The fabric softener composition of claim 3 containing at least about 50 weight percent water.

5. The fabric softener of claim 3 possessing a quaternary activity of at least about 2 percent.

6. The fabric softener of claim 4 possessing a quaternary activity of at least about 4 percent.

7. The fabric softener of claim 1 wherein the aliphatic residues of the hydrogenated triglyceride or hydrogenated fatty acids possess a ratio of cis isomer to trans isomer of from about 2:1 to about 9:1 and an iodine value of not greater than about 58.

8. The process of claim 1 wherein the secondary amine is diethylenetriamine.

9. The process of claim 1 wherein the amidodiester, -diamide or -esteramide is alkoxylated with the alkylene oxide in a mole ratio of propylene oxide to aminodiester, -diamide or -esteramide of from about 1 to about 4.

10. The process of claim 1 wherein the alkylating agent is a compound of the general formula $$R'''_m A$$

in which:

R''' is an alkyl radical of from 1 to 4 carbon atoms or a phenalkyl radical containing 1 or 2 carbon atoms in the alkyl radical;

A is an acid residue of an organic or inorganic acid; and m is the valency of A.

11. The process of claim 10 wherein the alkylating agent is selected from the group consisting of alkylhalide, benzylhalide and dialkylsulfate.

12. The fabric softener composition of claim 1 wherein (a) is obtained by the process which comprises reacting partially hydrogenated soy triglyceride in which the aliphatic residues possess a ratio of cis isomer to trans isomer of from about 1:1 to about 15:1 and an iodine value of not less than about 30 and not greater than about 70 with diethylene-triamine in a mole ratio of fatty acid to amine of at least about 1.85:1 to provide the corresponding aminodiamide, alkoxylating the aminodiamide with an alkylene oxide in a mole ratio of alkylene oxide to aminodiamide of from about 1:1 to about 4:1 to provide an alkoxylated fatty acid derivative and quaternizing the alkoxylated fatty acid derivative with alkylating agent selected from the group consisting of alkylhalide, benzylhalide and dialkylsulfate to provide the corresponding quaternary ammonium fatty acid derivative, the weight ratio of (a) to (b) in the composition being from about 8:1 to about 1:6.

13. The fabric softener of claim 1 in which the second quaternary ammonium fatty acid derivative of (b) is dihydrogenated tallow dimethyl ammonium.

14. The fabric softener of claim 12 in which the second quaternary ammonium fatty acid derivative of (b) is dihydrogenated tallow dimethyl ammonium.

15. A fabric softener composition comprising:

a) a first quaternary fatty acid derivative having the general formula:

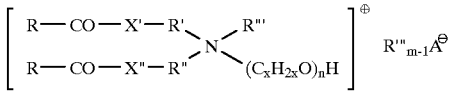

in which each R is the same or different and is the aliphatic residue of a partially hydrogenated fatty acid obtained from soy triglyceride, the aliphatic residue possessing a ratio of cis isomer to trans isomer of from about 1:1 to about 15:1 and an iodine value of not less than about 30 and not greater than about 70, X' and X" each is the same or different and is —O— or —NH—, R' and R" each is the same or different and is alkylene of from 2 to about 6 carbon atoms, R'" is hydrogen, an alkyl radical of from 1 to about 4 carbon atoms or a phenalkyl radical of 1 or 2 carbon atoms in the alkyl radical, x is 2 to 4, n is 1 to 4 and $R'''_{m-1}A^{\ominus}$ is an anion derived from an acid of the formula $R'''_{m}A$ in which A is an acid residue of an organic or inorganic acid and m is the valency of A; and, b) a second quaternary ammonium fatty acid derivative obtained from tallow acids.

16. The fabric softener composition of claim 15 wherein R'" is methyl, n is 1, and m is 1 or 2.

17. The fabric softener composition of claim 15 in which the second quaternary ammonium fatty acid derivative of (b) is dihydrogenated tallow dimethyl ammonium.

18. A fabric softener composition comprising:

a) a first quaternary fatty acid derivative having the general formula:

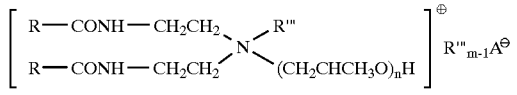

in which each R is the same or different and is an aliphatic residue of a partially hydrogenated fatty acid obtained from soy triglyceride, the aliphatic residue possessing a ratio of cis isomer to trans isomer of from about 1:1 to about 15:1 and an iodine value of not less than about 30 and not greater than about 70, R'" is hydrogen or an alkyl radical of from 1 to about 4 carbon atoms, n is 1 to 4 and $R'''_{m-1}A^{\ominus}$ is an anion derived from an acid of the formula $R'''_{m}A$ in which A is an acid residue of an organic or inorganic acid and m is the valency of A; and, b) a second quaternary ammonium fatty acid derivative obtained from tallow acids.

19. The fabric softener composition of claim 18 wherein R'" is methyl, n is 1, and m is 1 or 2.

20. The fabric softener composition of claim 18 in which the second quaternary ammonium fatty acid derivative of (b) is dihydrogenated tallow dimethyl ammonium.

* * * * *